US007776159B2

(12) United States Patent
Hooker et al.

(10) Patent No.: US 7,776,159 B2
(45) Date of Patent: Aug. 17, 2010

(54) METHODS AND APPARATUS FOR CONTROLLING A DISHWASHER

(75) Inventors: John Kenneth Hooker, Louisville, KY (US); Brendan Moser, Independence, KY (US); Timothy Martin Wetzel, Louisville, KY (US); James White, Crestwood, KY (US); Shelly Elizabeth Warms, Louisville, KY (US); Joseph Duane Tobbe, Taylorsville, KY (US)

(73) Assignee: General Electric Company, Schenectady, NY (US)

( * ) Notice: Subject to any disclaimer, the term of this patent is extended or adjusted under 35 U.S.C. 154(b) by 850 days.

(21) Appl. No.: 11/323,234

(22) Filed: Dec. 30, 2005

(65) Prior Publication Data

US 2007/0151579 A1 Jul. 5, 2007

(51) Int. Cl.
*B08B 7/00* (2006.01)
*B08B 3/00* (2006.01)

(52) U.S. Cl. ..... 134/56 D; 134/18

(58) Field of Classification Search ..... 134/18, 134/56 D, 56 R
See application file for complete search history.

(56) References Cited

U.S. PATENT DOCUMENTS 4,404,811 A 9/1983 Mount et al.
4,481,786 A 11/1984 Bashark
5,284,580 A 2/1994 Shyh
5,330,580 A * 7/1994 Whipple et al. ..... 134/18
5,768,729 A * 6/1998 Cracraft ..... 8/158
6,735,705 B1 5/2004 Egbert et al.
6,887,318 B2 * 5/2005 Bashark ..... 134/18
2004/0044816 A1 3/2004 Hooker et al.
2004/0099287 A1 * 5/2004 Shin ..... 134/18
2005/0005952 A1 * 1/2005 Bashark ..... 134/18
2006/0219262 A1 * 10/2006 Peterson et al. ..... 134/18

* cited by examiner

*Primary Examiner*—Michael Kornakov
*Assistant Examiner*—Natasha Campbell
(74) *Attorney, Agent, or Firm*—George L. Rideout, Esq.; Armstrong Teasdale LLP

(57) ABSTRACT

A control system for controlling a fill operation of a dishwasher having a pump and a pump motor driving the pump, and the dishwasher having a valve for controlling the flow of water to the dishwasher includes a monitoring device configured to be coupled to at least one of the pump and the pump motor. The monitoring device generates an output relating to at least one of an operating current and a speed of the pump motor. The control system also includes a controller configured to be operatively coupled to the valve, wherein the controller receives the output and is configured to operate the valve based on the output. The output relates to a fill condition of the dishwasher.

14 Claims, 12 Drawing Sheets

METHODS AND APPARATUS FOR CONTROLLING A DISHWASHER

BACKGROUND OF THE INVENTION

This invention relates generally to dishwashers, and more particularly, to methods and apparatus for filling a dishwasher.

Reducing the amount of energy consumption by a fluid-handling dishwasher for cleansing articles is a significant problem, in part because of increasing worldwide energy demand. In such dishwashers, the amount of energy consumed is primarily determined by the amount of energy needed to heat the liquid, such as water, used to cleanse the articles. Thus, decreased liquid consumption for such dishwashers can result in a significant improvement in energy efficiency.

Dishwashers typically receive liquid for a predetermined duration through a conduit connected to the dishwasher. A wash cycle for a dishwasher for cleansing articles may include providing substantially particle-free liquid to the dishwasher, circulating or distributing the liquid during the wash cycle, and draining or flushing the liquid from the dishwasher after being used to wash the articles. Typically, a dishwasher user has limited control over the amount of liquid provided for a wash cycle, such as by selection from a few predetermined options. Such a dishwasher does not use liquid efficiently because variations in liquid pressure or degradation in dishwasher components generally require providing liquid for an excessive duration to ensure a more than sufficient amount for a wash cycle. Closed loop feedback control is one method to improve water conservation in dishwashers. Several devices are available to monitor or measure the amount or volume of liquid provided for a wash cycle.

Devices for measuring the amount of liquid, such as water, provided to a dishwasher for cleansing articles include flowmeters that measure the water flow rate to the dishwasher and water level sensors that detect the static air pressure in an air cavity in the sensor. However, such devices may be difficult or non-economic to implement, may be unreliable, may degrade over time, and may not provide robust measurements relative to the dishwashers incorporating them. Furthermore, the accuracy of such devices is not entirely satisfactory due to variations in the amount of liquid needed to satisfactorily cleanse varying amounts of soiled articles.

A need thus exists for a dishwasher for cleansing articles incorporating a closed loop feedback system for monitoring and controlling the amount of liquid provided for a wash cycle.

BRIEF DESCRIPTION OF THE INVENTION

In one aspect, a control system is provided for controlling a fill operation of a dishwasher having a pump and a pump motor driving the pump, and the dishwasher having a valve for controlling the flow of water to the dishwasher. The control system includes a monitoring device configured to be coupled to at least one of the pump and the pump motor. The monitoring device generates an output relating to at least one of an operating current and a speed of the pump motor. The control system also includes a controller configured to be operatively coupled to the valve, wherein the controller receives the output and is configured to operate the valve based on the output. The output relates to a fill condition of the dishwasher.

In another aspect, a dishwasher is provided including a pump, a pump motor driving the pump, and a valve for controlling the flow of water within the dishwasher. The dishwasher also includes a monitoring device configured to be coupled to at least one of the pump and the pump motor. The monitoring device generates an output relating to at least one of an operating current and a speed of the pump motor. The dishwasher includes a controller configured to be operatively coupled to the valve, wherein the controller receives the output and is configured to operate the valve based on the output. The output relates to a fill condition of the dishwasher.

In a further aspect, a method is provided of controlling a fill operation of a dishwasher having a pump and a pump motor driving the pump, and a valve for controlling the flow of water to the dishwasher. The method includes providing a monitoring device configured to be coupled to at least one of the pump and the pump motor, and generating an output at the monitoring device relating to at least one of an operating current and a speed of the pump motor. The method also includes providing a controller configured to be operatively coupled to the valve, receiving the output at the controller, and operating the valve based on the output, wherein the output relates to a fill condition of the dishwasher.

DETAILED DESCRIPTION OF THE INVENTION

Figure 1:
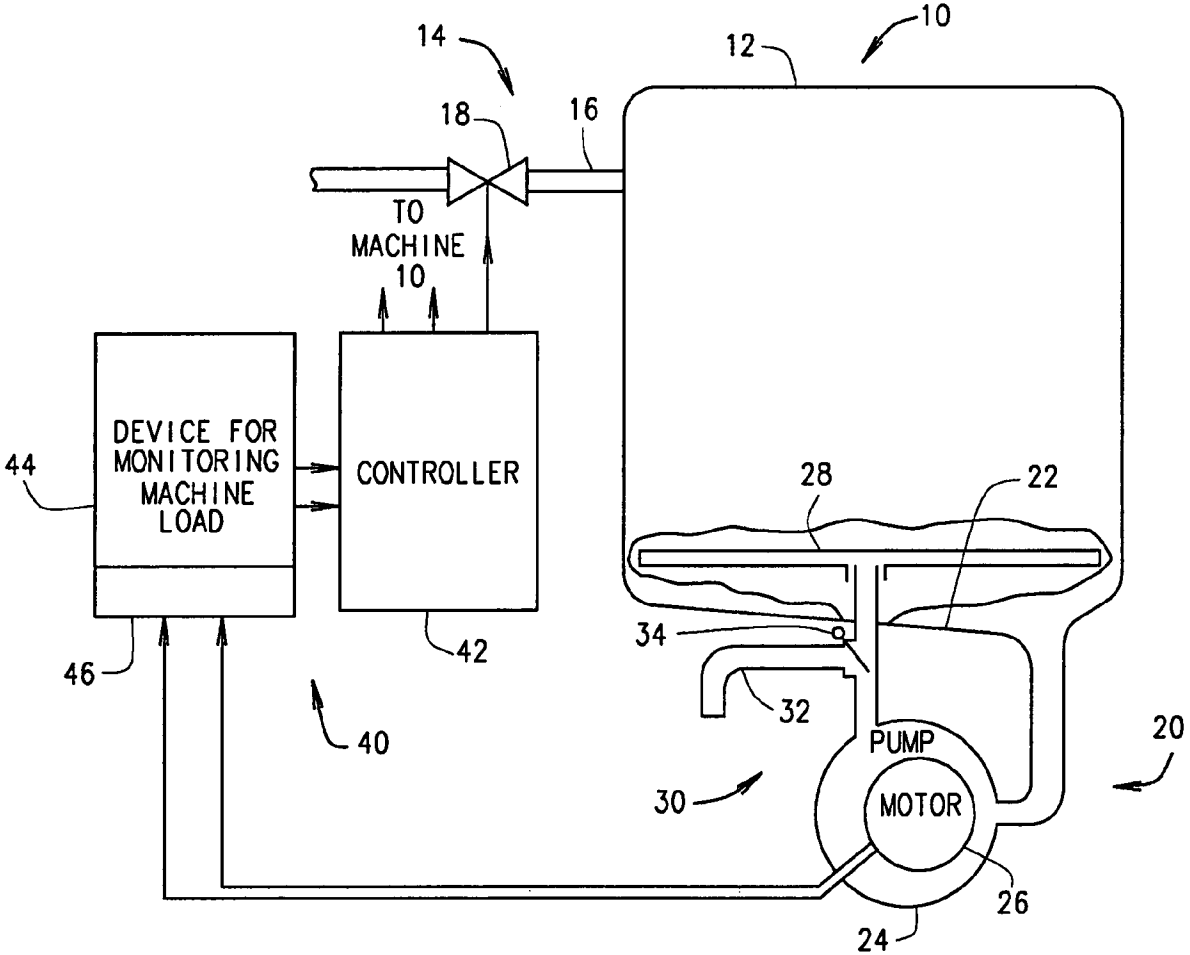
FIG. 1 is a schematic diagram of an exemplary dishwasher.

FIG. 1 illustrates an exemplary dishwasher 10 including a frame 12 for containing articles, such as food handling articles. Dishwasher 10 includes a subsystem 14 to provide substantially particle-free liquid to frame. Subsystem 14 includes a supply conduit 16 coupled to a water supply source, such as plumbing lines. Conduit 16 is coupled to frame 12 such that water may be delivered to an interior of frame 12. A valve 18 is coupled to conduit 16 for controlling water flow through conduit 16.

Dishwasher also includes a subsystem 20 to distribute or circulate the liquid within frame 12. Subsystem 20 includes a sump 22 positioned at a bottom portion of frame 12 and a pump 24 in flow communication with sump 22. Water is delivered to pump 24 via sump 22. A motor 26 is operatively coupled to pump 24 for driving pump 24. In operation, motor 26 consumes power to distribute or circulate water in frame 12. Subsystem 20 also includes a spray arm 28 in flow communication with pump 24. In operation, water is delivered to spray arm 28 by pump 24.

Dishwasher 10 includes a subsystem 30 to remove liquid from frame 12. Subsystem 30 includes sump 22, pump 24 and an outlet 32. Additionally, subsystem 30 includes a valve 34 for controlling flow into outlet 32. In operation, water is channeled from sump 22 to pump 24. Valve 34 is opened to allow water to flow into outlet 32 to remove liquid from frame 12. When valve 34 is closed, the flow of liquid is directed to spray arm 28.

Dishwasher 10 also includes a control subsystem 40 to operate dishwasher 10 during a wash cycle. For example, dishwasher 10 may be operated in a variety of modes of operation within a wash cycle, such as, a fill mode, a drain mode, a pre-rinse mode, at least one main wash mode, and a final rinse mode. The drain mode may be utilized between each rinse or wash mode. Subsystem 40 includes a controller 42 for operating the various components of dishwasher 10, such as, for example, pump 24, motor 26, valve 18, valve 34, and the like. As such, controller 42 controls an amount of fluid entering and exiting frame 12, and controller 42 controls the circulation of the fluid within frame 12. Subsystem 40 also includes a monitoring device 44 for monitoring a dishwasher load. Dishwasher load refers to the power consumed by motor 26. In the exemplary embodiment, device 44 receives signals from motor 26, processes the signals and provides an output to controller 42. Controller 42 includes control logic to operate dishwasher 10 based upon the output from device 44. Controller 42 may control dishwasher 10 based upon other inputs or other control logic in addition to the output from device 44.

Monitoring device 44 includes a sensor 46, such as, for example, a current sensor, for monitoring dishwasher load. Sensor 46 detects the power consumption surges of motor 26 as pump 24 is operated. Power consumption surges refers to substantial changes in power consumption when dishwasher load is changing. In the exemplary embodiment, device 44 and sensor 46 are utilized during a fill operation of dishwasher as frame 12 receives water though conduit 16. In alternative embodiments, device 44 and sensor 46 may also be used to monitor and determine if a liquid load of dishwasher 10 during a wash cycle is adequate. Liquid load refers to the amount of liquid being circulated or distributed in dishwasher 10 during a wash cycle. Liquid load is defined relative to a sufficient amount of liquid for a particular wash cycle. However, in a given mode of operation, the liquid load may exceed this sufficient amount or it may be less than this sufficient amount.

In the exemplary embodiment, device 44 and sensor 46 monitor a motor load during operation of dishwasher 10 to determine the adequacy of the liquid load. Motor load refers to the power consumed by motor 26 to distribute or circulate a given liquid load in the dishwasher and is substantially the same load as dishwasher load.

Device 44 may include any one of a number possible sensors for detecting power consumption surges of motor 26. Power consumption surges occur because pump 24 is not fully primed and air is channeled through pump 24. For example, when the liquid load is below a threshold amount and when an inadequate amount of water is contained within frame 12, air is channeled through pump 24. Channeling air through pump 24 produces oscillations or surges in the power consumption of motor 26 because less power is consumed by motor 26 when air enters the liquid distribution subsystem 20. An insufficient liquid load is caused during filling of frame 12, until an adequate amount of water is channeled into frame 12, because the amount of water provided to frame 12 is insufficient to fill sump 26, spray arm 28 and all of any other portions of a subsystem 20 for circulating or distributing the liquid. However, as frame 12 continues to receive water, the oscillations or surges in the power consumption of motor 26 begin to dampen. This occurs because gradually dishwasher 10 receives an amount of liquid sufficient for that wash cycle mode. Additionally, the number of articles contained in frame 12 may affect when a sufficient liquid load has been provided because the articles may absorb or entrap liquid, or liquid may adhere to the articles.

As illustrated in FIG. 1, controller 42 receives one or more signal inputs and provides one or more signal outputs. A signal input to controller 42 is a power consumption measurement provided by device 44 as frame 12 receives liquid. In particular, signals providing measurements for detecting power consumption surges of motor 26 may include measurements of motor current, motor power, motor speed, motor phase angle difference, and the like. A number of other signals from dishwasher 10, such as signals conveying information about progress of a washing or of a particular wash cycle, may also be provided to controller 42. Furthermore, a number of signal inputs may be provided by controller 42 to dishwasher 10 for feedback control.

Figure 2:
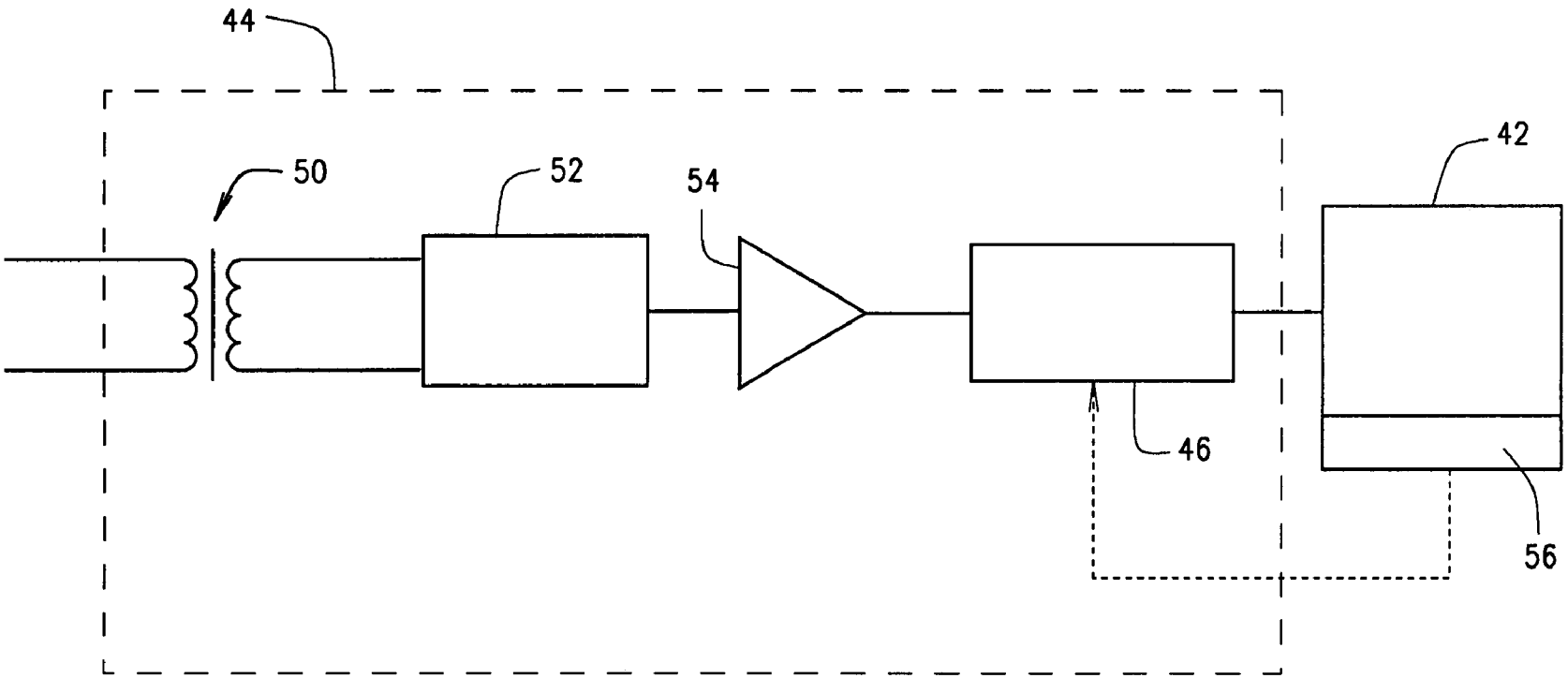
FIG. 2 is a schematic diagram of an exemplary device for monitoring a dishwasher load and used with the dishwasher shown in FIG. 1.

FIG. 2 is a schematic diagram of monitoring device 44 for monitoring the dishwasher load in accordance with an exemplary embodiment. Device 44 includes a current transformer 50 receiving voltage from motor 26 (shown in FIG. 1). In one embodiment, device 44 also includes a filter component (not shown) for filtering signals transmitted at predetermined frequencies, such as, for example, high frequencies. As such, signals unrelated to surging of motor 26 may be filtered. An analog to digital (A/D) converter 52 is positioned downstream of transformer 50. A/D converter 52 produces an output. In the exemplary embodiment, the output is processed by an amplifier 54 and then analyzed by sensor 46. In the exemplary embodiment, sensor 46 analyzes the output to detect an amplitude of the current of motor 26. For example, in one embodiment, sensor 46 is a peak and hold circuit. Sensor 46 transmits an output to controller 42. In one embodiment, controller 42 also includes an A/D converter 56. In the exemplary embodiment, and as will be described in more detail below, controller 42 transmits a signal back to sensor 46, such as, for example, a peak detector reset signal that actively discharges the voltage at sensor 46. Alternatively, the voltage is passively discharged.

FIGS. 3-11 are flow diagrams showing exemplary operations or control algorithms of dishwasher 10 (shown in FIG. 1). The operations are used to monitor and/or control the liquid load of dishwasher 10. For example, the operations are used during a fill mode of dishwasher 10, and the water fill amount is controlled by controller 42 (shown in FIG. 1) based on inputs from monitoring device 44. As indicated above, the current of motor 26 is varied based on the amount of water and/or air channeled through pump 24. In the exemplary embodiment, monitoring device 44 monitors the amplitude of the current of motor 26 (shown in FIG. 1). By monitoring the current amplitude, and by measuring or determining changes in the amplitude, controller 42 and monitoring device 44 are used to fill frame 12 (shown in FIG. 1) to an appropriate level. Additionally, by monitoring the current amplitude, and by measuring or determining changes in the amplitude, overfilling of frame 12 with water is reduced and power consumption of dishwasher 10 is thus reduced. In some embodiments, the operations are used to monitor the current amplitude of motor 26 after the water fill mode, such as during the rinse or wash mode. As such, additional water can be added to frame 12 during the rinse or wash cycle based on signals from device 44.

Figure 3:
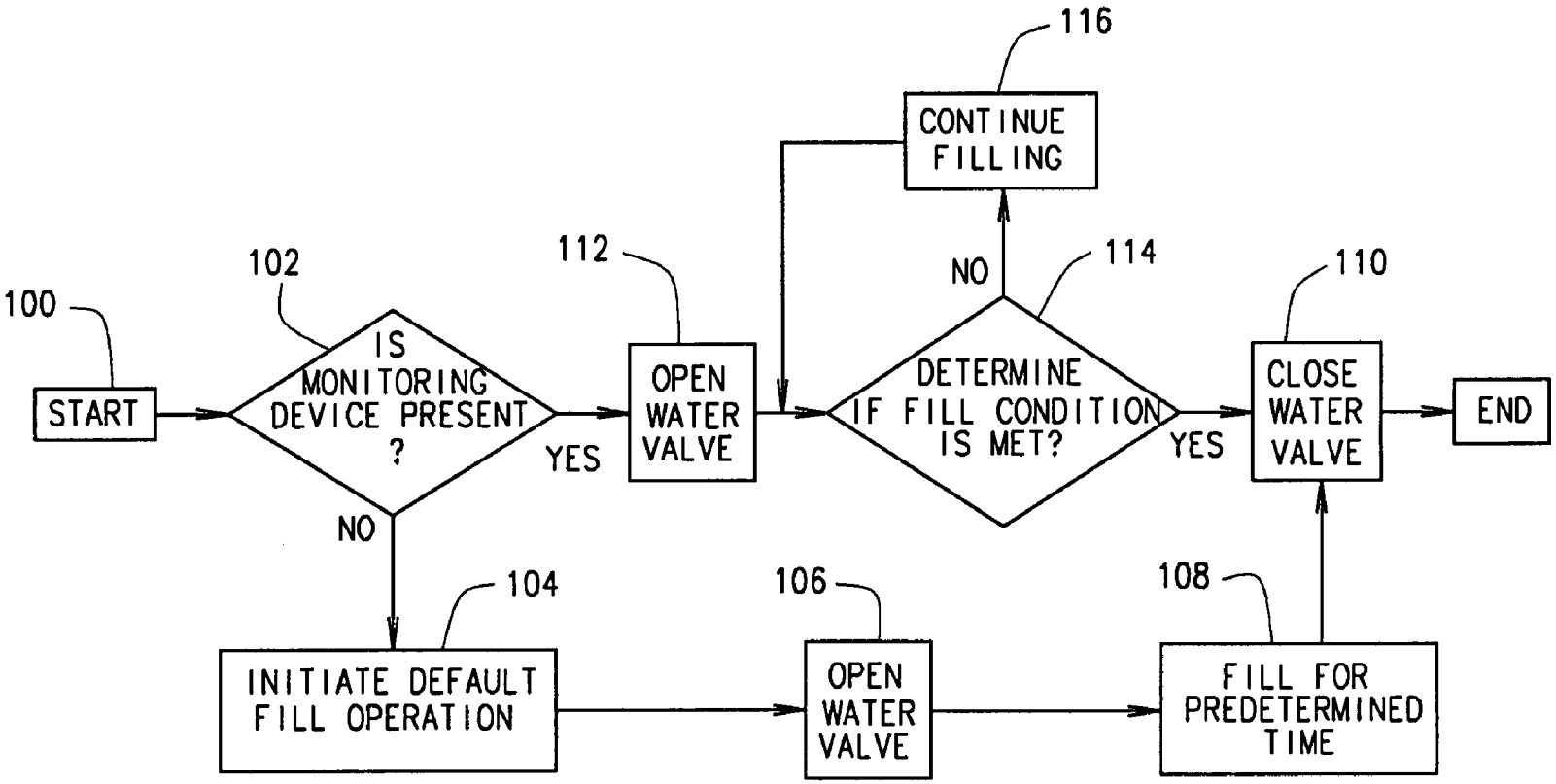
FIGS. 3-11 are flow diagrams showing exemplary operations of the dishwasher shown in FIG. 1.

Turning to FIG. 3, a fill operation is illustrated, wherein water is channeled to frame 12 to a fill level as determined by controller 42. The operation is initiated 100, and controller 42 determines 102 if a monitoring device 44 is present. If no monitoring device 44 is detected, a default fill operation is initiated 104. Water valve 18 is opened 106 and frame 12 is filled 108 for a predetermined time. The water valve 18 is then closed 110. The fill operation is then ended.

However, if monitoring device 44 is detected, then an adaptive fill operation is accomplished by controlling the amount of water based on operating characteristics of dishwasher 10. For example, a more precise amount of water is channeled to dishwasher 10 as compared to dishwashers 10 that fill for a predetermined amount of time. In the exemplary embodiment, the amount of water corresponds to the type of load, and less water may be used to fill dishwasher 10. water valve 18 is opened 112 and frame 12 is filled. In operation, controller 42 determines 114 if a fill condition or level is met. If the fill condition is not met, filling continues 116. Controller 42 again determines 114 if the fill condition is met. When the fill condition is met, valve 18 is closed 110 and the fill operation is ended. In the exemplary embodiment, less water is used to fill dishwasher 10 in the adaptive fill mode than in the default fill mode. For example, the fill condition is satisfied in less time than the default fill operation uses to fill dishwasher 10.

In one embodiment, the motor 26 is turned off during filling, and then turned on for the monitoring. As such, noise is reduced during the fill condition.

Figure 4:
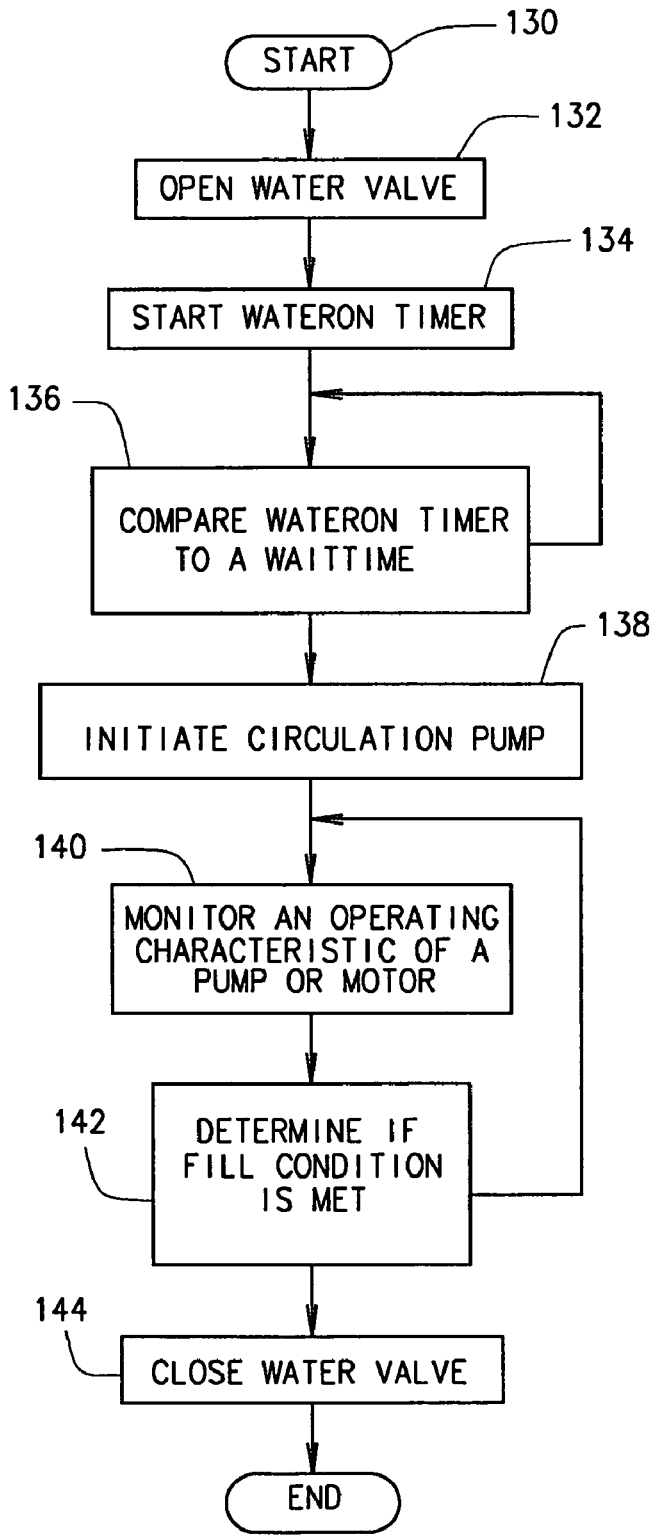

Turning to FIG. 4, another exemplary fill operation is illustrated. The fill operation is used to control the liquid load of dishwasher 10. For example, the motor current is monitored and then controller 42 determines when a fill condition is met. The operation is initiated 130 and valve 18 is opened 132. A WaterOnTimer is started 134 when valve 18 is opened 132. The elapsed time of the WaterOnTimer is compared 136 to a predetermined WaitTime. The WaitTime is pre-programmed in the control logic of controller 42. The WaitTime allows a predetermined amount of fill time before other components of dishwasher 10 are initiated, such as for example, pump 24. In one embodiment, the WaitTime is approximately one minute. When the elapsed time of the WaterOnTimer is greater than or equal to the WaitTime, controller 42 initiates 138 pump 24. Once pump 24 is on, monitoring device 44 monitors 140 an operating characteristic or surging condition of pump 24 or motor 26. For example, in the exemplary embodiment, the operating characteristic relates to an operating current of motor 26. The operating current may be an absolute current value or a change in current value. In another embodiment, the operating characteristic relates to a speed of motor 26. The speed may be an absolute speed value or a change in speed value. Controller 42 determines 142 if a fill condition or level is met based on the operating characteristic. If the fill condition is not met, monitoring device 44 continues to monitor 140. However, when the fill condition is met, valve 18 is closed 144 and the fill operation is ended.

Figure 5:
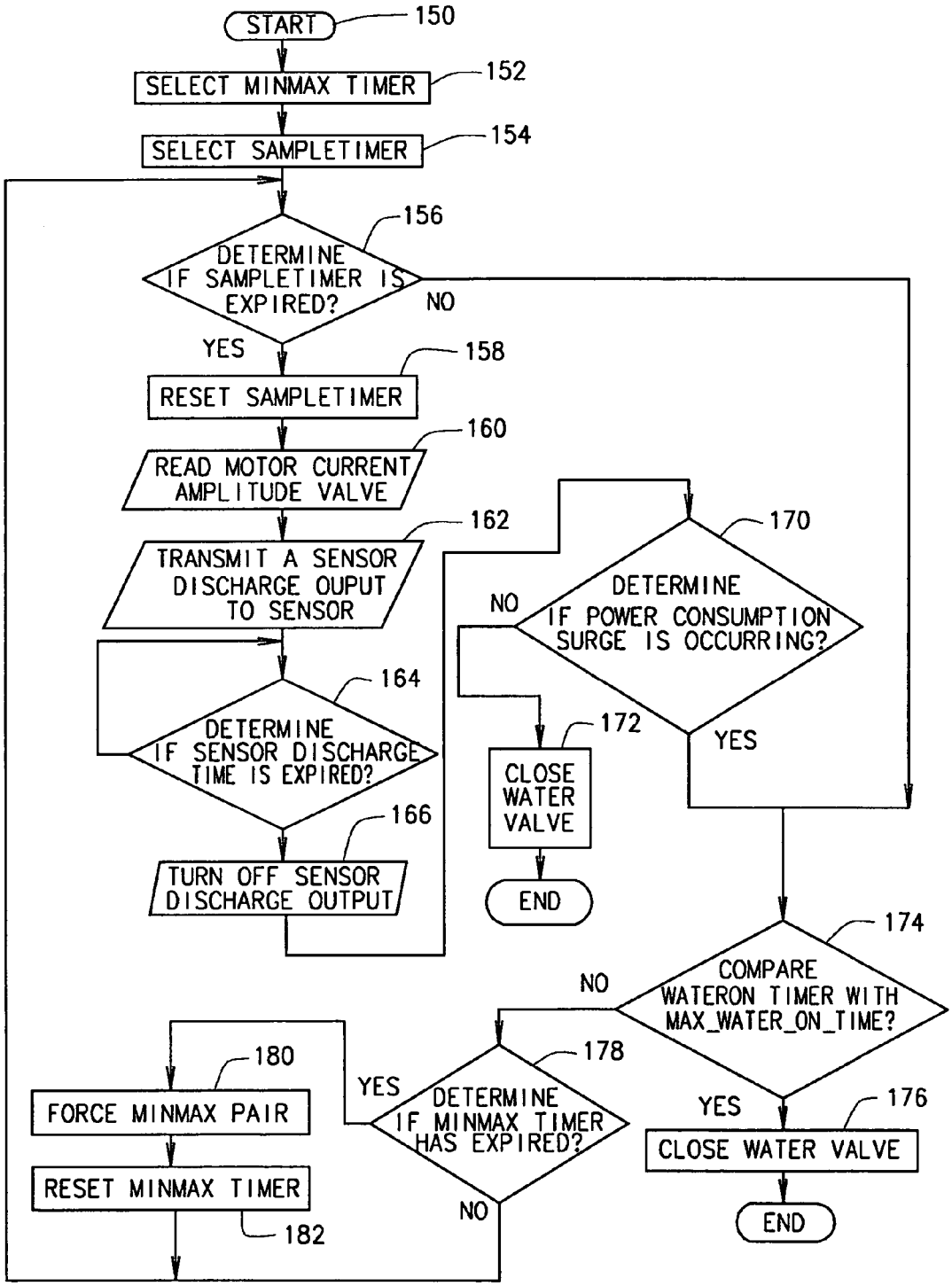

Turning to FIG. 5, an exemplary current monitoring operation is illustrated. The current monitoring operation may be used, for example, in step 140 described with respect to FIG. 4. The current monitoring operation is used to identify surging of motor 26. As discussed above, motor surging corresponds to an insufficient liquid load, and thus more water is needed in frame 12 to fully prime pump 24.

The operation is initiated 150 and a MinMaxTime is selected 152 and a SampleTime is selected 154. A MinMaxTimer measures the MinMaxTime and a SampleTimer measures the SampleTime. In the exemplary embodiment, the MinMaxTime and SampleTime are pre-programmed in the control logic of controller 42. As will be described in further detail below, the MinMaxTime is selected 152 as a maximum time allowable for controller 42 to determine a minimum current amplitude of motor 26 and a maximum time allowable for controller 42 to determine a maximum current amplitude of motor 26. For example, if a minimum or maximum current amplitude is not determined after the selected MinMaxTime, then a current amplitude will be forced according to the most recent amplitude. As will be described in further detail below, the SampleTime is selected 154 as a predetermined time interval for monitoring device 44 to sample the current amplitude of motor 26.

In operation, controller 42 samples data relating to the current of motor 26 to identify power consumption surges. The data is transmitted to controller 42 from monitoring device 44. In the exemplary embodiment, controller 42 determines 156 if SampleTimer is expired. If the SampleTimer is expired, the SampleTimer is reset 158 and controller 42 reads or determines 160 the current amplitude value from monitoring device 44. In the exemplary embodiment, when the value is determined 160, controller 42 transmits 162 a sensor discharge output to sensor 46 (shown in FIG. 2) of device 44. The sensor discharge output resets sensor 46. Controller 42 determines 164 if a sensor discharge time has expired. Once the sensor discharge time is expired, the sensor discharge output is turned off 166. Alternatively, the operation is performed without steps 162, 164 and 166.

After the current amplitude value is determined, and in the exemplary embodiment, after the sensor discharge output is turned off 166, controller 42 determines 170 if a power consumption surge is occurring. If no power consumption surge is occurring, valve 18 is closed 172, and the fill operation is ended. However, if a power surge is occurring, the current monitoring operation is continued. Controller 42 compares 174 an elapsed time of a WaterOnTimer with a MaxWaterOnTime. When the elapsed time of the WaterOnTimer is greater than or equal to the MaxWaterOnTime, controller 42 closes 176 valve 18, and the fill operation is ended. However, if the WaterOnTimer is less than the MaxWaterOnTime, controller 42 determines 178 if MinMaxTimer has expired. If the MinMaxTimer has not expired, the current monitoring operation is continued by running another iteration, such as at step 156. If the MinMaxTimer is expired, controller 42 forces 180 a minimum or maximum current amplitude according to the most recent amplitude value determined. Once the amplitude value is forced 180, the MinMaxTimer is reset 182 and the current monitoring operation is continued by running another iteration, such as at step 156.

Figure 6A:
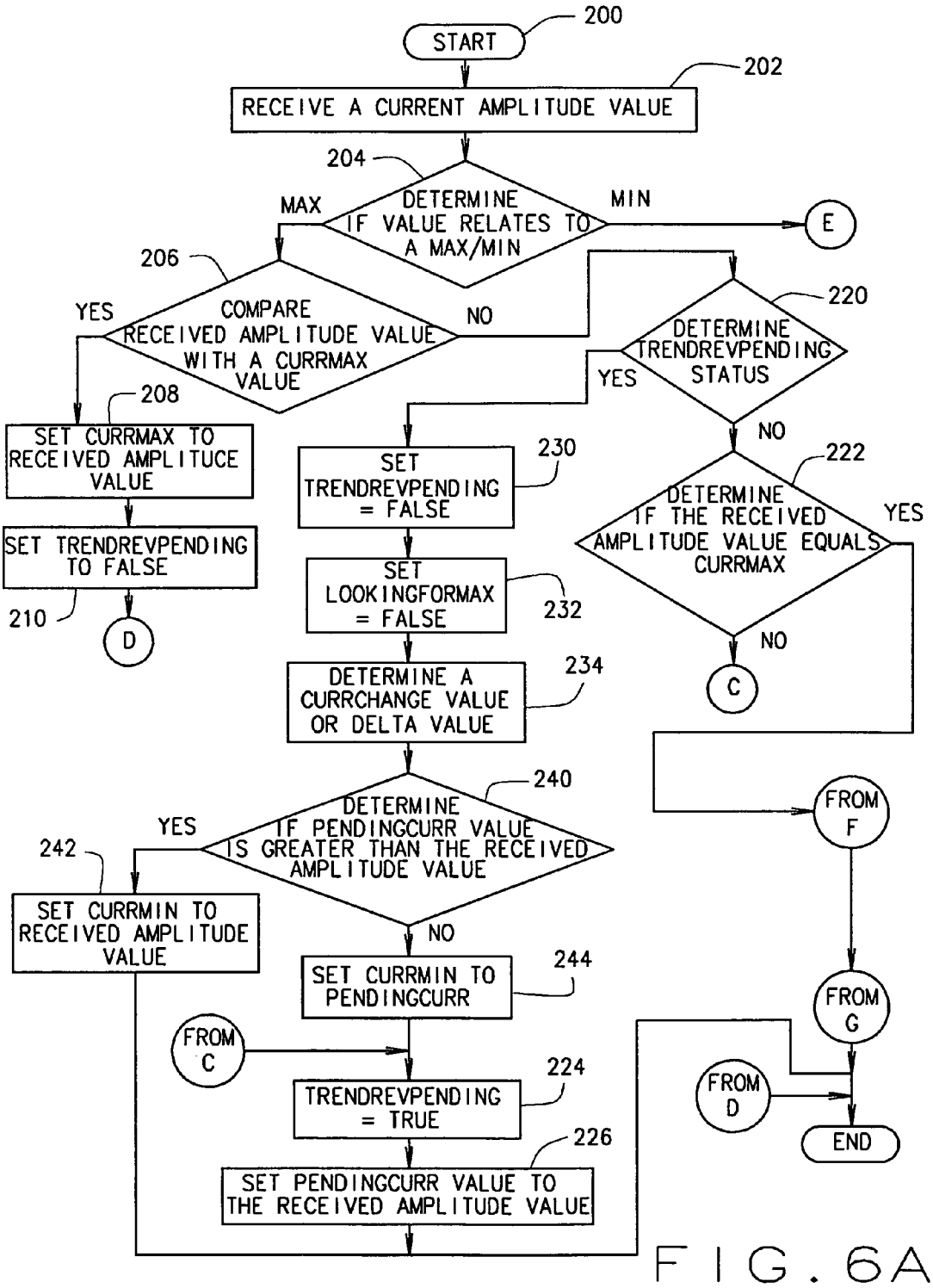
Figure 6B:
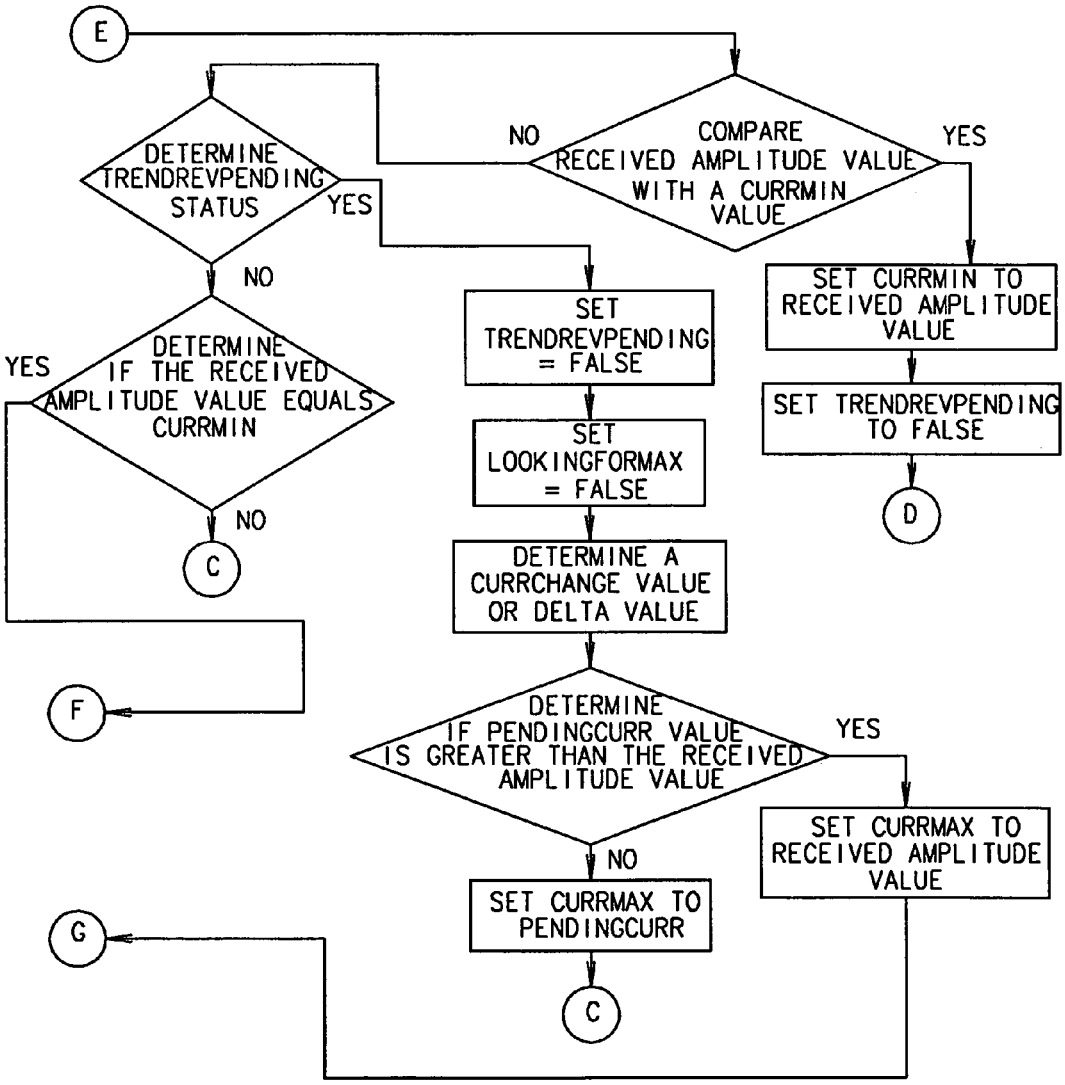

Turning to FIG. 6, an exemplary power consumption surge occurrence operation is illustrated. The operation is illustrated as FIGS. 6A and 6B. The power consumption surge occurrence operation may be used, for example, in step 170 described with respect to FIG. 5. The power consumption surge occurrence operation is used to identify local maximum and local minimum amplitude values. For example, as the current of motor 26 is surging, the current amplitude oscillates. The peaks, or local maximum and local minimum values, are identified so controller 42 may determine if motor 26 is surging. As discussed above, motor surging corresponds to an insufficient liquid load, and thus more water is needed in frame 12 to fully prime pump 24.

The operation is initiated 200 and controller 42 receives 202 a current amplitude value. Controller then determines 204 if device 44 is transmitting signals relating to a maximum current amplitude or a minimum current amplitude based on a trend established from prior iterations. For example, a LookingForMax value can either be set to TRUE or FALSE. FIG. 6A relates to a situation wherein controller 42 is looking for a maximum. FIG. 6B relates to a situation wherein controller 42 is looking for a minimum. If controller 42 is looking for a maximum current amplitude, the received amplitude value is compared 206 to a CurrMax value. The CurrMax value is the previous maximum amplitude value within an increasing amplitude value trend. If the received amplitude value is greater than the CurrMax value, then the CurrMax value is set 208 to equal the received amplitude value. Additionally, a TrendRevPending value is set 210 to FALSE and the operation continues, such as, for example, to step 172 described with respect to FIG. 5, or to generate another data value. The TrendRevPending value can either be TRUE or FALSE, and relates to a change in the trend of amplitude values. For example, if the preceding samples have had increasing amplitudes, but the received amplitude value is less than the previously obtained amplitude value, then the trend may be reversing. For example, the next amplitude values may each be decreasing toward a local minimum. However, it is possible that the received value is a perturbation, and that the trend will continue toward a local maximum. As such, in the exemplary embodiment, controller 42 monitors for more than one amplitude value to determine if the trend has changed.

At step 206, if the received amplitude value is less than the CurrMax value, then controller 42 determines 220 the status of the TrendRevPending value. If the value is set to FALSE, then controller 42 determines 222 if the received amplitude value is equal to the CurrMax value. If the values are equal, the operation continues, such as, for example, to step 172 described with respect to FIG. 5, or to generate another data value. However, if the values are not equal, then the TrendRevPending value is set 224 to TRUE and a PendingCurr value is set 226 to the received current value. The PendingCurr value is used in successive iterations to compare and determine a trend. After step 226, the operation continues, such as, for example, to step 172 described with respect to FIG. 5, or to generate another data value.

At step 220, if the TrendRevPending value is set to TRUE, then the trend has reversed and the local maximum has been determined (i.e. in a previous iteration). As such, controller 42 sets 230 the TrendRevPending value to FALSE, sets 232 the LookingForMax value to FALSE, and determines 234 a CurrChange value or Delta value. The CurrChange value or Delta value is the change in amplitude between the identified maximum and the identified minimum amplitudes, or the difference between the most recently identified local minimum and local maximum values. The Delta value is used to identify if motor 26 is surging. For example, if the Delta value is above a predetermined threshold value, then motor 26 is surging and more water is needed in frame 12.

Once the Delta value is determined 234, controller 42 determines 240 if the PendingCurr value is greater than the received amplitude value. If the PendingCurr is greater than the received amplitude value, then controller 42 sets 242 CurrMin to the received amplitude value, and the operation continues, such as, for example, to step 172 described with respect to FIG. 5, or to generate another data value. However, if the PendingCurr is less than the received amplitude value, then controller 42 sets 244 CurrMin to the PendingCurr value, and controller 42 sets 224 the TrendRevPending value to TRUE and the PendingCurr value is set 226 to the received current amplitude value. The PendingCurr value is used in successive iterations to compare and determine a trend. After step 226, the operation continues, such as, for example, to step 172 described with respect to FIG. 5, or to generate another data value.

At step 204, if controller 42 is not looking for the maximum, or if the LookingForMax value is set to FALSE, then controller will look for the minimum amplitude value. FIG. 6B illustrates the situation where controller 42 is looking for the minimum amplitude value. The process is substantially similar to the process of looking for the maximum. For example, controller 42 compares the received amplitude value to the previous or PendingCurr value. If the received value is less than the PendingCurr value, then the local minimum value is yet to be determined. However, if the received value is greater than the PendingCurr value, then the local minimum value may have already been found. Controller 42 will determine if a TrendRevPending has occurred. Once the local minimum has been found, the Delta value is determined and controller 42 determines if surging is occurring.

Figure 7:
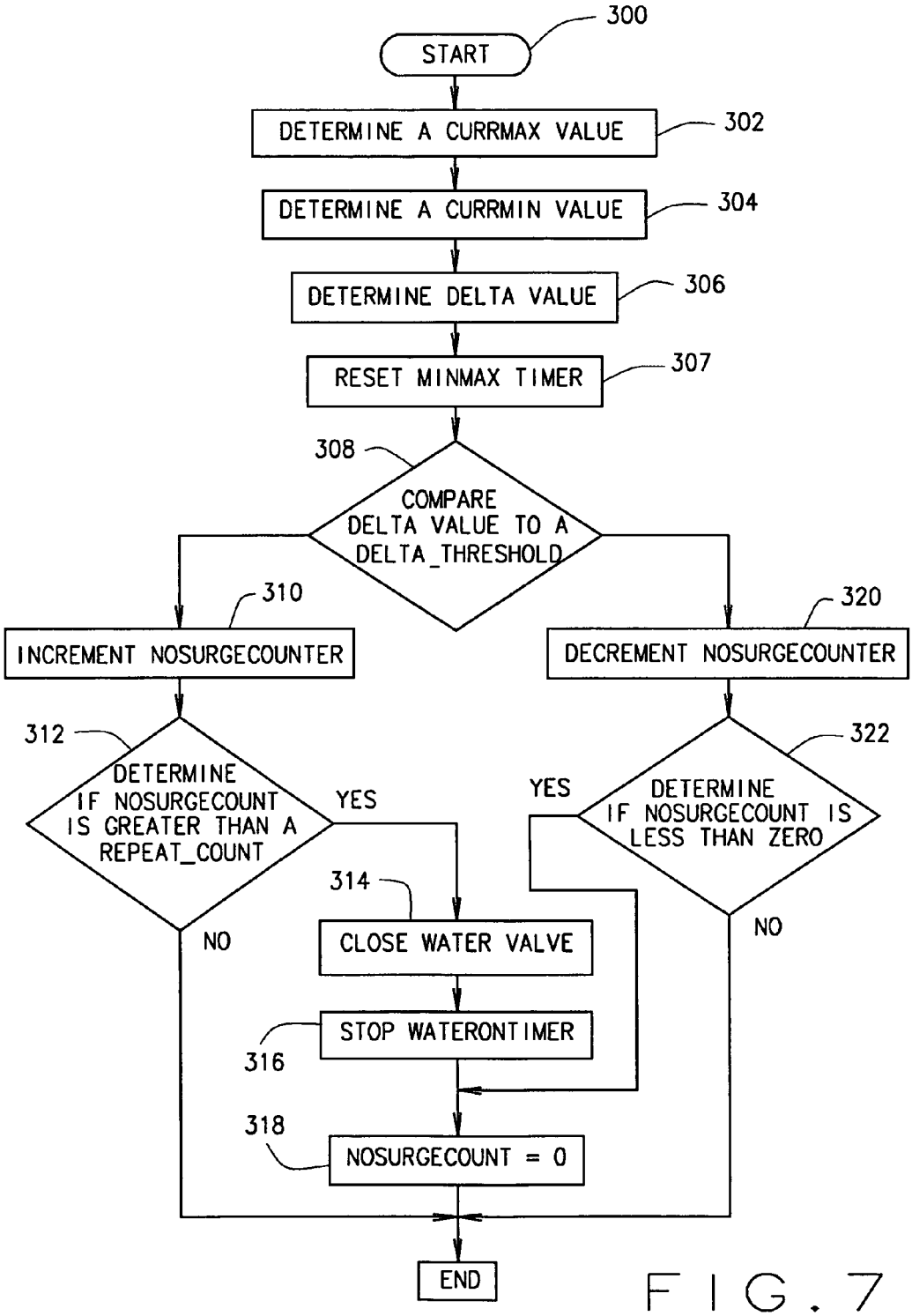

Turning to FIG. 7, an exemplary power consumption surge occurrence operation is illustrated. The power consumption surge occurrence operation may be used, for example, in step 234 described with respect to FIG. 6. The power consumption surge occurrence operation is used to identify a CurrentChange value or Delta value. The Delta value is the change in amplitude between identified maximum and minimum amplitudes, or the difference between the most recently identified local minimum and local maximum values. The Delta value is used to identify if motor 26 is surging. For example, if the Delta value is above a predetermined threshold value, then motor 26 is surging and more water is needed in frame 12. As discussed above, motor surging corresponds to an insufficient liquid load, and thus more water is needed in frame 12 to fully prime pump 24.

The operation is initiated 300 and controller 42 determines 302 a CurrMax value and controller 42 determines 304 a CurrMin value. The CurrMax value corresponds to the most recently identified maximum current amplitude and the CurrMin value corresponds to the most recently identified minimum current amplitude. Controller determines 306 a Delta value or a change in amplitude between the CurrMax and the CurrMin by subtracting the CurrMin from the CurrMax. Once the Delta value is determined 306, controller resets 307 a MinMaxTimer that determines a maximum amount of time for determining a local minimum or a local maximum. In the exemplary embodiment, if the time of MinMax Timer has expired a local minimum or a local maximum is forced to the most recently identified amplitude value.

After the Delta value is determined 306, the Delta value is compared 308 to a Delta Threshold. The Delta Threshold is a value that may be pre-programmed in the control logic of controller 42. The Delta Threshold may vary depending on the type of dishwasher 10 or the type of motor 26 used. Additionally, the Delta Threshold may vary depending on operating conditions of dishwasher 10 or motor 26. For example, the Delta Threshold may vary depending on a line voltage from motor 26. If the Delta value is below the Delta Threshold, then motor 26 is not surging and pump 24 is primed. Thus frame 12 has an adequate amount of water, and a water fill operation can be stopped. However, if the Delta value is above the Delta Threshold, then motor 26 is surging, and additional water is needed to prime pump 24.

In the exemplary embodiment, when controller 42 has determined that a non-surging condition exists, controller 42 does not immediately shut off the water. Rather, controller 42 identifies a series or multiple non-surging conditions in a row prior to shutting off the water. For example, when the Delta value is below the Delta Threshold, controller 42 increments 310 a NoSurgeCounter by a variable or constant, such as, for example, one. The NoSurgeCounter tracks a NoSurgeCount. Controller 42 determines 312 if the NoSurgeCount is greater than a RepeatCount. The RepeatCount is a predetermined amount of counts corresponding to a non-surging condition of motor 26. For example, in one embodiment, the RepeatCount is a constant, such as, for example, fifty. However, the number may be more or less than fifty depending on variables, such as, the type of dishwasher 10, the size of the dishwasher 10, the size of conduit 16, the flow rate of water entering frame 12, and other variables relating to the water fill operation. If the NoSurgeCount is less than the RepeatCount, then the operation continues, such as, for example, to step 240 described with respect to FIG. 6, or to determine 306 another delta value. However, if the NoSurgeCount is greater than the RepeatCount, then a non-surging condition is satisfied. Controller 42 closes 314 valve 18, the WaterOnTimer is stopped 316, and the NoSurgeCount is reset 318 to zero. In the exemplary embodiment, the operation continues such as, for example, to step 240 described with respect to FIG. 6. In alternative embodiments, the fill operation is ended after the non-surging condition is satisfied.

At step 308, if controller 42 determines that the Delta value is above the Delta Threshold, a surging condition is identified. Controller 42 decrements 320 the NoSurgeCounter. In one embodiment, the NoSurgeCounter is decremented by an amount equal to half of the RepeatCount. Alternatively, the NoSurgeCounter is decremented by a constant, such as, for example, ten. In other embodiments, the NoSurgeCounter is reduced to zero. After the NoSurgeCounter is decremented, controller 42 determines 322 if the NoSurgeCount is less than zero. If the NoSurgeCount is less than zero, controller 42 resets 318 the NoSurgeCount to zero. However, if the NoSurgeCount is greater than zero, the operation is continued, such as, for example, to step 240 described with respect to FIG. 6.

Figure 8:
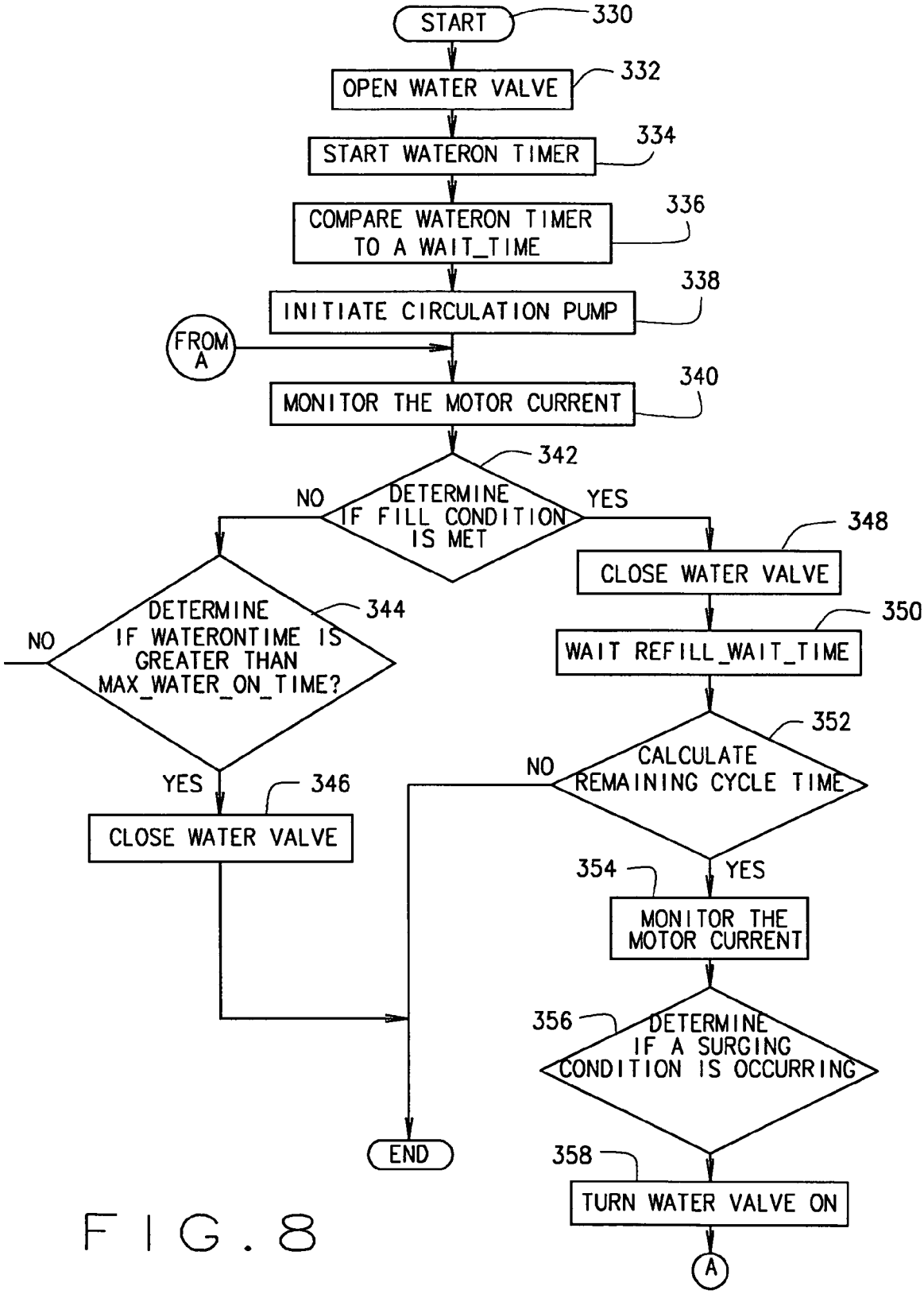

Turning to FIG. 8, another exemplary fill operation is illustrated. The fill operation relates to a refill procedure wherein controller 42 determines if a surging condition of motor 26 is occurring after an initial fill cycle has been completed and valve 18 has been turned off. The operation is initiated 330 and valve 18 is opened 332. A WaterOnTimer is started 334 when valve 18 is opened 332. The elapsed time of the WaterOnTimer is compared 336 to a predetermined WaitTime. The WaitTime is pre-programmed in the control logic of controller 42. The WaitTime allows a predetermined amount of fill time before other components of dishwasher 10 are initiated, such as for example, pump 24. In one embodiment, the WaitTime is approximately one minute. When the elapsed time of the WaterOnTimer is greater than or equal to the WaitTime, controller 42 initiates 338 pump 24. Once pump 24 is on, monitoring device 44 monitors 340 the current of motor 26. Controller 42 determines 342 if a fill condition or level is met. For example, in the exemplary embodiment, controller 42 samples current amplitude levels, such as described with respect to the current monitoring operation of FIG. 5. Controller 42 also checks for power consumption surge occurrences to identify local maximum and local minimum amplitude values, such as described with respect to FIG. 6. Controller 42 also checks for power consumption surge occurrences to identify a CurrentChange value or Delta value, such as described with respect to FIG. 7.

If controller 42 determines 342 that the fill condition is not met, monitoring device 44 continues to monitor 340. Controller 42 determines 344 if the WaterOnTime is greater than a MaxWaterOnTime. If the WaterOnTime is greater than the MaxWaterOnTime, then valve 18 is closed 346 and the fill operation is ended. However, if the WaterOnTime is less than the MaxWaterOnTime, the operation continues, such as to step 340 to gather more data. Controller 42 again determines 342 if a fill condition or level is met.

At step 342, once controller 42 determines that the fill condition is met, valve 18 is closed 348. Controller 42 then waits 350 for a predetermined RefillWaitTime. RefillWaitTime is an amount of time that elapses after an initial fill is completed, but before controller 42 again determines if a non-surging condition of motor 26 exists. For example, dishwasher 10 is operated for a predetermined amount of time, and then controller 42 re-assesses the operating condition of dishwasher 10 to determine if dishwasher 10 is under-filled. RefillWaitTime is selected depending on variables, such as, the type of dishwasher 10, the size of the dishwasher 10, and the like. In one embodiment, RefillWaitTime is approximately twenty seconds. Once controller 42 waits 350 for the RefillWaitTime, controller 42 calculates 352 a remaining cycle time. The remaining cycle time is the time left until the particular cycle mode is complete. The remaining cycle time is based on variables, such as, the type of dishwasher 10, the size of the dishwasher 10, the particular cycle mode, the time for the filling mode, and the like. If there is not enough cycle time remaining, the filling operation is ended. However, if cycle time remains, monitoring device 44 monitors 354 the motor current. Controller 42 determines 356 if a surging condition is occurring. If surging is occurring, controller 42 turns 358 water valve 18 on, and the fill operation continues, such as, for example, at step 340. However, if a non-surging condition is determined 356, then the operation continues, such as, at step 352.

Figure 9:
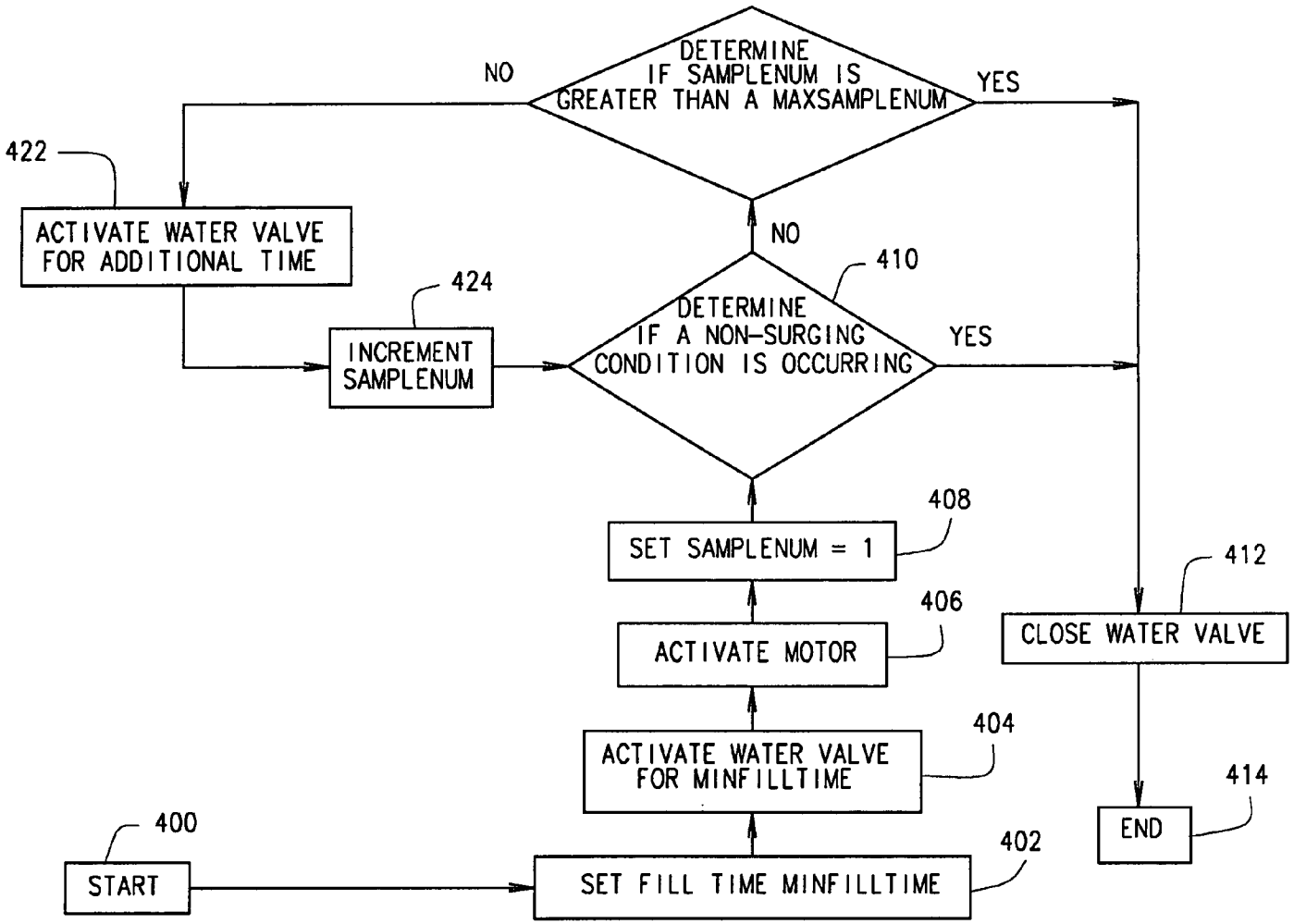

Turning to FIG. 9, another exemplary fill operation is illustrated. The fill operation uses a method of incrementally filling frame 12 until a non-surging condition is occurring. The method facilitates reducing the overall amount of water used to fill frame 12. For example, the method starts with a minimum fill, checks for a non-surging condition, initiates an additional fill if surging is still occurring, and then re-checks for a non-surging condition. The process is repeated for a predetermined number of iterations. Once a non-surging condition is detected, the fill operation is ended.

In the exemplary fill operation illustrated in FIG. 9, the operation is initiated 400, and controller 42 sets 402 a fill time to a MinFillTime. The MinFillTime is a minimum fill time pre-programmed in the control logic of controller 42. The MinFillTime is based on variables, such as, the type of dishwasher 10, the size of the dishwasher 10, the particular cycle mode, and the like. Controller 42 then activates 404 water valve 18 for the MinFillTime. Controller 42 then activates 406 motor 26. In one embodiment, motor 26 is activated after a predetermined wait time to allow a predetermined amount of filling prior to activation. Once motor 26 is activated, controller sets 408 a SampleNum to one. Controller 42 then determines 410 if a non-surging condition is occurring in motor 26. In the exemplary embodiment, controller 42 uses the current amplitude level of motor 26 to determine 410 if a non-surging condition is occurring. In one embodiment, controller 42 samples current amplitude levels, such as described with respect to the current monitoring operation of FIG. 5. Controller 42 also checks for power consumption surge occurrences to identify local maximum and local minimum amplitude values, such as described with respect to FIG. 6. Controller 42 also checks for power consumption surge occurrences to identify a CurrentChange value or Delta value, such as described with respect to FIG. 7. However, controller 42 may sample other conditions, such as, motor power, motor speed, motor phase angle difference, and the like.

If a non-surging condition is occurring, valve 18 is closed 412, and the filling operation is ended 414. However, if a surging condition is occurring, controller 42 determines 420 if the SampleNum is greater than a predetermined MaxSampleNum. The MaxSampleNum relates to the maximum number of samples checked by controller 42. In one embodiment, the MaxSampleNum is three. If the SampleNum is greater than the MaxSampleNum, then valve 18 is closed 412, and the filling operation is ended 414. However, if the SampleNum is less than the MaxSampleNum, then controller 42 activates 422 water valve 18 for an additional fill time. Additionally, controller 42 increments 424 SampleNum by an increment, such as one. Controller 42 again determines 410 if a non-surging condition is occurring in motor 26, and the fill operation continues.

Figure 10:
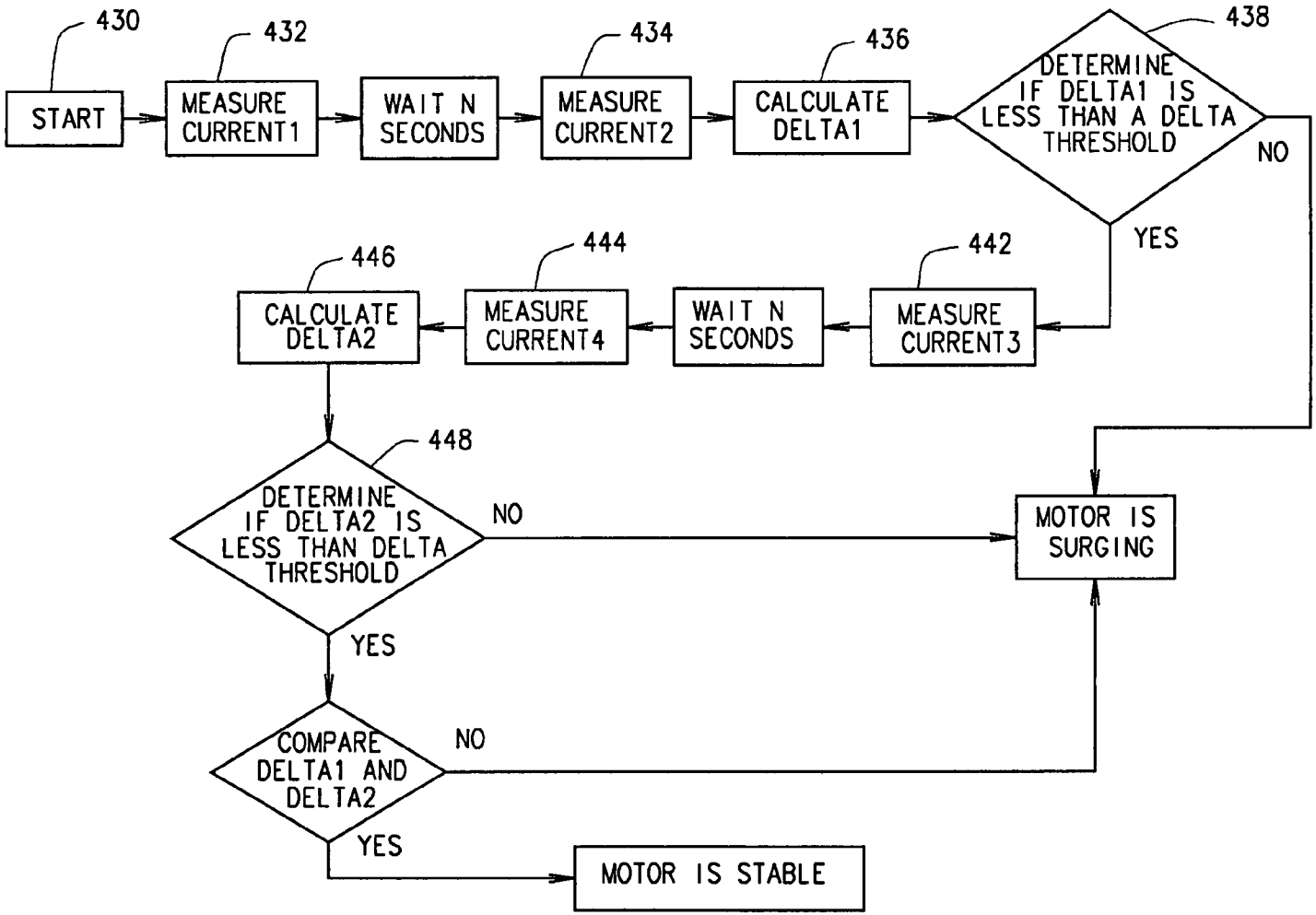

Turning to FIG. 10, an exemplary current monitoring operation is illustrated. The current monitoring operation may be used, for example, in step 140 described with respect to FIG. 4. The current monitoring operation is used to identify surging of motor 26 by measuring the stability of the current of motor 26. As discussed above, motor surging corresponds to an insufficient liquid load, and thus more water is needed in frame 12 to fully prime pump 24. If the current is fluctuating by a predetermined amount, then motor 26 is surging. However, if the current is stable, such that the fluctuation of the current is less than a predetermined amount, then motor 26 is in a non-surging condition.

The operation is initiated 430 and controller 42 measures 432 a motor current value. The measured current value is identified as Current1. After a predetermined amount of time, such as, for example, three seconds, controller 42 measures 434 another motor current value. The measured current value is identified as Current2. Controller 42 then calculates 436 a change or delta value. For example, the delta value is calculated 436 by subtracting Current2 from Current1. The delta value is identified as Delta1. Controller 42 determines 438 if Delta1 is less than a Delta Threshold. The Delta Threshold is a value that may be pre-programmed in the control logic of controller 42. The Delta Threshold may vary depending on the type of dishwasher 10 or the type of motor 26 used. Additionally, the Delta Threshold may vary depending on operating conditions of dishwasher 10 or motor 26. If Delta1 is above the Delta Threshold, then motor 26 is surging and additional water is needed to prime pump 24. However, if Delta1 is below the Delta Threshold, then the operation continues.

Controller 42 measures 442 a motor current value. The measured current value is identified as Current3. After a predetermined amount of time, controller 42 measures 444 another motor current value. The measured current value is identified as Current4. Controller 42 then calculates 446 another delta value. For example, the delta value is calculated 446 by subtracting Current4 from Current3. The delta value is identified as Delta2. Controller 42 determines 448 if Delta2 is less than a Delta Threshold. If Delta2 is above the Delta Threshold, then motor 26 is surging and additional water is needed to prime pump 24. However, if Delta2 is below the Delta Threshold, then the operation continues, and controller 42 compares 450 Delta1 and Delta2. For example, Delta2 is subtracted from Delta1, and if the compared value is less than a predetermined amount, then motor 26 is stable and in a non-surging condition. However, if the compared value is greater than a predetermined amount, then motor 26 is surging, and additional water is needed. As such, a fill operation continues. In alternative embodiments, more than two iterations are performed to determine of motor 26 is stable.

Figure 11:
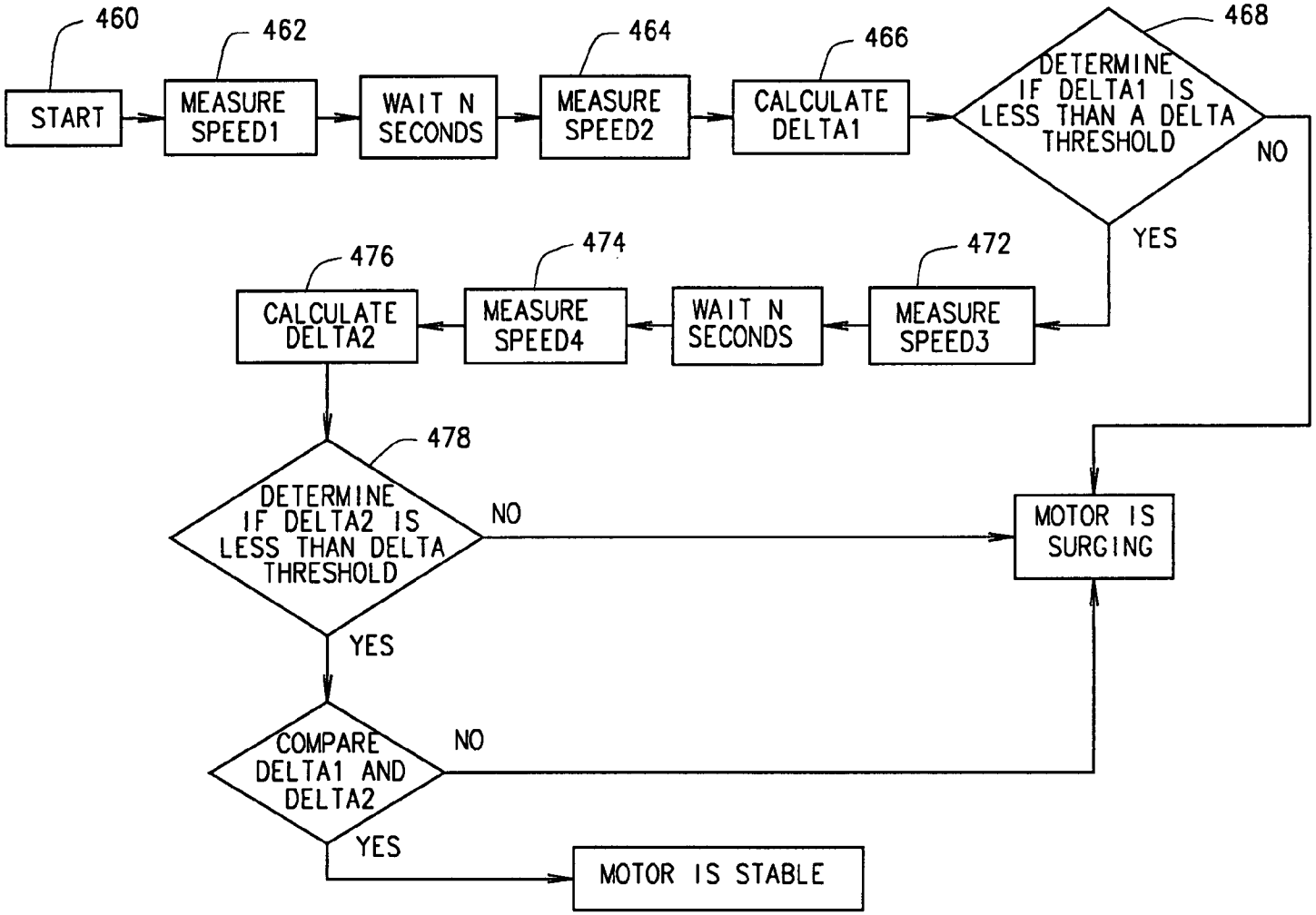

Turning to FIG. 11, an exemplary speed monitoring operation is illustrated. The speed monitoring operation may be used, for example, in step 140 described with respect to FIG. 4. The speed monitoring operation is used to identify surging of motor 26 by measuring the stability of the speed of motor 26. As discussed above, motor surging corresponds to an insufficient liquid load, and thus more water is needed in frame 12 to fully prime pump 24. If the motor 26 is surging, then the speed of the motor 26 may be fluctuating. However, in a non-surging condition, the speed of the motor 26 is typically substantially stable, or the change in speed is below a predetermined amount. In the exemplary embodiment, the speed of the motor 26 is measured in rotations per minute (RPM's), and is measured by a tachometer coupled to the motor shaft or other portions of the motor. In one embodiment, the speed of a pump impeller may be monitored to determine the speed of the motor 26.

The operation is initiated 460 and controller 42 measures 462 a motor speed value. The measured speed value is identified as Speed1. After a predetermined amount of time, such as, for example, three seconds, controller 42 measures 464 another motor speed value. The measured speed value is identified as Speed2. Controller 42 then calculates 466 a change or delta value. For example, the delta value is calculated 466 by subtracting Speed2 from Speed1. The delta value is identified as Delta1. Controller 42 determines 468 if Delta1 is less than a Delta Threshold. The Delta Threshold is a value that may be pre-programmed in the control logic of controller 42. The Delta Threshold may vary depending on the type of dishwasher 10 or the type of motor 26 used. Additionally, the Delta Threshold may vary depending on operating conditions of dishwasher 10 or motor 26. If Delta1 is above the Delta Threshold, then motor 26 is surging and additional water is needed to prime pump 24. However, if Delta1 is below the Delta Threshold, then the operation continues.

Controller 42 measures 472 a motor speed value. The measured speed value is identified as Speed3. After a predetermined amount of time, controller 42 measures 474 another motor speed value. The measured speed value is identified as Speed4. Controller 42 then calculates 476 another delta value. For example, the delta value is calculated 476 by subtracting Speed4 from Speed3. The delta value is identified as Delta2. Controller 42 determines 478 if Delta2 is less than a Delta Threshold. If Delta2 is above the Delta Threshold, then motor 26 is surging and additional water is needed to prime pump 24. However, if Delta2 is below the Delta Threshold, then the operation continues, and controller 42 compares 450 Delta1 and Delta2. For example, Delta2 is subtracted from Delta1, and if the compared value is less than a predetermined amount, then motor 26 is stable and in a non-surging condition. However, if the compared value is greater than a predetermined amount, then motor 26 is surging, and additional water is needed. As such, a fill operation continues. In alternative embodiments, more than two iterations are performed to determine of motor 26 is stable.

In the methods described above, detecting power consumption surges in an apparatus driving a liquid circulation or distribution subsystem for dishwasher 10, such as motor 75 in pump 70, includes several alternative embodiments. In one embodiment, detecting power consumption surges includes measuring the current of the motor, or any changes thereof. In an alternative embodiment, detecting power consumption surges includes measuring the speed of a rotor connected to the motor, or any changes thereof. In still another embodiment, detecting power consumption surges includes measuring the magnitude of the phase angle difference between the alternating current of the motor and the alternating voltage of the motor, or any changes thereof. The methods also involve using a controller 42 to determine if a fill condition or level is met. For example, controller 42 samples current amplitude levels, checks for power consumption surge occurrences to identify local maximum and local minimum amplitude values, and also checks for power consumption surge occurrences to identify the change, particularly the fluctuation or stability of the change in amplitude, to determine if motor 26 is surging.

Exemplary embodiments of dishwashers, and more particularly, control systems and operations of dishwashers, are described above in detail. Each dishwasher and/or control system is not limited to the specific embodiments described herein, but rather each component or functions may be utilized independently and separately from other components or function described herein. Each component or function can also be used in combination with components or functions described in other embodiments.

While the invention has been described in terms of various specific embodiments, those skilled in the art will recognize that the invention can be practiced with modification within the spirit and scope of the claims.

What is claimed is:

1. A control system for controlling a liquid load of a dishwasher having a pump, a pump motor driving the pump, and a valve for controlling the flow of water to the dishwasher, said control system comprising:

a monitoring device configured to be coupled to at least one of the pump and the pump motor, said monitoring device comprising a sensor configured to receive and analyze at least one of a voltage and a current from the at least one of the pump and the pump motor, said sensor further configured to generate an output relating to at least one of an operating current and a speed of the pump motor; and a controller configured to be operatively coupled to the valve, said controller configured to:

receive the output of said sensor;

count a number of times said controller identifies an existence of a non-surge condition based on the output;

determine that a fill condition of the dishwasher has been met after a count exceeds a predefined number of counts;

close the valve based on a determination that the fill condition has been met; and transmit a signal back to said sensor to discharge said sensor.

2. A control system in accordance with claim 1 wherein said monitoring device further comprises a current transformer and an analog to digital converter.

3. A control system in accordance with claim 2 wherein said monitoring device further comprises at least one of an amplifier and a filtering device configured to pass frequencies relating to a power surging condition.

4. A control system in accordance with claim 1 wherein said controller opens the valve for a predetermined amount of time before said monitoring device generates the output.

5. A control system in accordance with claim 1 wherein said controller closes the valve at predetermined intervals to sample at least one of the operating current and the speed of the pump motor or pump to determine if the fill condition is met.

6. A control system in accordance with claim 1, said monitoring device configured to generate the output based on samples taken at predetermined intervals.

7. A control system in accordance with claim 1 wherein the output relates to at least one of a current amplitude and a speed amplitude, said controller configured to determine an amplitude minimum and an amplitude maximum.

8. A control system in accordance with claim 1 wherein the output relates to at least one of a current amplitude and a speed amplitude, said controller configured to determine a change in amplitude.

9. A control system in accordance with claim 8 wherein the change in amplitude is compared to a threshold value to determine if the fill condition is satisfied.

10. A control system in accordance with claim 9 wherein the threshold value is based on a line voltage of the dishwasher.

11. A control system in accordance with claim 1 wherein said controller is configured to open the valve when the output relates to a surging condition of the dishwasher.

12. A dishwasher comprising:

a pump;

a pump motor driving said pump;

a valve for controlling the flow of water to the dishwasher;

a monitoring device configured to be coupled to at least one of said pump and pump motor, said monitoring device comprising a sensor configured to receive and analyze at least one of a voltage and a current from said at least one of said pump and pump motor, said sensor further configured to generate an output relating to at least one of an operating current and a speed of said pump motor; and a controller configured to be operatively coupled to said valve, said controller configured to:

receive the output of said sensor;

count a number of times said controller identifies an existence of a non-surge condition based on the output;

determine that a fill condition of the dishwasher has been met after a count exceeds a predefined number of counts;

close said valve based on a determination that the fill condition has been met; and transmit a signal back to said sensor to discharge said sensor.

13. A dishwasher in accordance with claim 12 wherein the output relates to at least one of a current amplitude and a speed amplitude, said controller configured to determine an amplitude minimum and an amplitude maximum to determine if the fill condition is met.

14. A dishwasher in accordance with claim 12 wherein the output relates to at least one of a current amplitude and a speed amplitude, said controller configured to determine a change in amplitude to determine if the fill condition is met.

* * * * *